United States Patent [19]

Richards

[11] 4,419,771

[45] Dec. 13, 1983

[54] PASSIVE DISPENSER

[75] Inventor: Randall G. Richards, Cincinnati, Ohio

[73] Assignee: The Drackett Company, Cincinnati, Ohio

[21] Appl. No.: 346,975

[22] Filed: Feb. 8, 1982

[51] Int. Cl.[3] ..... E03D 9/02; E03D 9/03

[52] U.S. Cl. ..... 4/228; 4/227

[58] Field of Search ..... 4/228, 227, 222, 226, 4/225; 222/52, 54, 425, 450

[56] References Cited

U.S. PATENT DOCUMENTS

| | | | |
|---|---|---|---|
| Re. 11,941 | 10/1901 | Thomson | 4/228 |
| 650,161 | 5/1900 | Williams et al. | 4/228 |
| 668,762 | 6/1901 | Thomson . | |
| 969,729 | 9/1910 | Smith | 4/228 |
| 991,825 | 5/1911 | Bogie | 4/228 X |
| 1,144,525 | 6/1915 | Blake | 4/228 |
| 1,175,032 | 3/1916 | Williams | 4/228 |
| 1,213,978 | 1/1917 | Thornton | 4/227 |
| 1,987,689 | 1/1935 | Lewis | 4/228 |
| 2,688,754 | 7/1954 | Willits et al. | 4/228 |
| 2,839,763 | 6/1950 | Newsom | 4/228 |
| 3,073,488 | 1/1963 | Komter | 22/394 |
| 3,121,236 | 2/1964 | Yadro et al. | 4/228 |
| 3,339,801 | 7/1967 | Hronas | 222/57 |
| 3,341,074 | 9/1967 | Pannuti | 222/57 |
| 3,407,412 | 10/1968 | Spear | 4/228 |
| 3,423,182 | 1/1969 | Klasky | 4/228 |
| 3,444,566 | 5/1969 | Spear | 4/228 |
| 3,504,384 | 4/1970 | Radley et al. | 4/228 |
| 3,604,020 | 9/1971 | Moisa | 4/228 |
| 3,618,143 | 11/1971 | Hill et al. | 4/228 |
| 3,698,021 | 10/1972 | Mack et al. | 4/227 |
| 3,769,640 | 11/1973 | Castronovo | 4/228 |
| 3,772,715 | 1/1973 | Nigro | 4/228 |
| 3,778,849 | 12/1973 | Foley | 4/228 |
| 3,781,926 | 1/1974 | Levey | 4/228 |
| 3,784,058 | 1/1974 | Buchtel | 4/228 |
| 3,864,763 | 2/1975 | Spransy | 4/227 |
| 3,867,101 | 2/1975 | Herring | 4/228 |
| 3,895,379 | 1/1974 | Buchtel | 4/227 X |
| 3,934,279 | 1/1976 | Mallin | 4/228 |
| 3,943,582 | 3/1976 | Daeninckx et al. | 4/227 |
| 3,952,339 | 4/1976 | Baur et al. | 4/228 |
| 3,965,497 | 6/1976 | Corsette | 4/227 |
| 4,036,407 | 7/1977 | Slone | 222/188 |
| 4,064,572 | 12/1977 | Wicks et al. | 4/227 |
| 4,171,546 | 10/1979 | Dirksing | 4/228 |
| 4,186,856 | 2/1980 | Dirksing | 4/228 |
| 4,208,747 | 6/1980 | Dirksing | 4/228 |
| 4,216,027 | 7/1980 | Wages | 4/228 X |
| 4,244,062 | 1/1981 | Corsette | 4/228 |
| 4,251,012 | 2/1981 | Owens et al. | 4/227 X |
| 4,281,421 | 8/1981 | Nyquist et al. | 4/228 |
| 4,305,162 | 12/1981 | Cornelisse, Jr. et al. | 4/228 |
| 307,474 | 12/1981 | Choy | 4/228 |

FOREIGN PATENT DOCUMENTS

| | | | |
|---|---|---|---|
| 91804 | 11/1921 | Switzerland . | |
| 705904 | 3/1954 | United Kingdom | 4/228 |
| 916652 | 1/1963 | United Kingdom . | |
| 1057865 | 2/1967 | United Kingdom . | |

*Primary Examiner*—Stephen Marcus
*Assistant Examiner*—Kenneth S. Putnam
*Attorney, Agent, or Firm*—Charles J. Zeller; George A. Mentis

[57] ABSTRACT

The present invention provides a passive dispenser for use in a toilet tank in which the solution to be dispensed is isolated from the water in the toilet tank. The dispenser comprises of internal reservoir for storing a quantity of the solution, an upper venting means having passive means to provide an upper air-lock, and discharge/refill conduit disposed below the upper venting means, the conduit comprising an air trap chamber and an air refill chamber connected by a transfer port so as to provide a lower air-lock for isolating the solution from the water in the toilet tank.

8 Claims, 14 Drawing Figures

FIG. 1
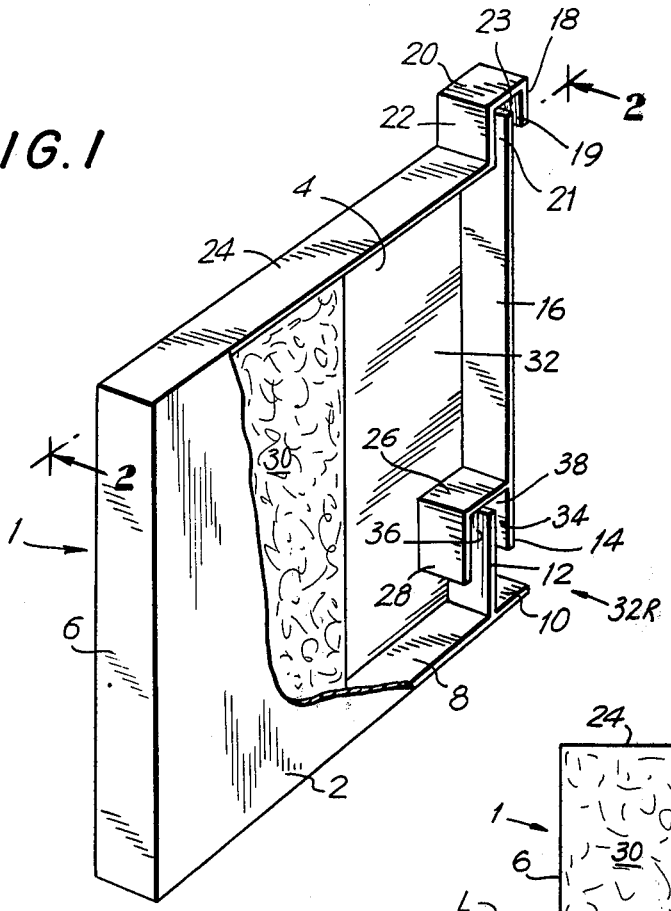
FIG. 2
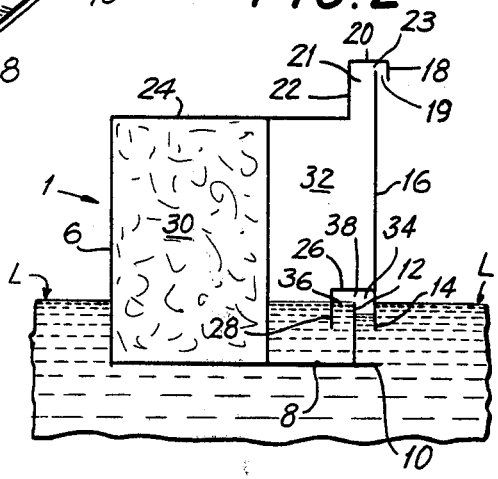
FIG. 3
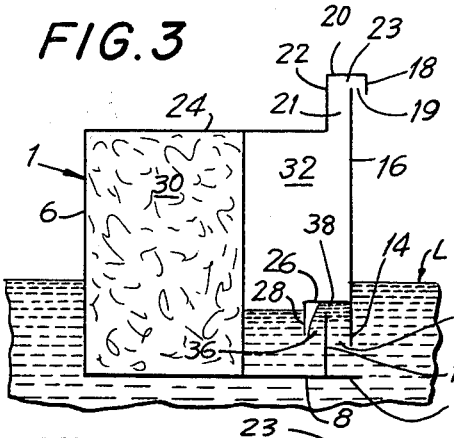
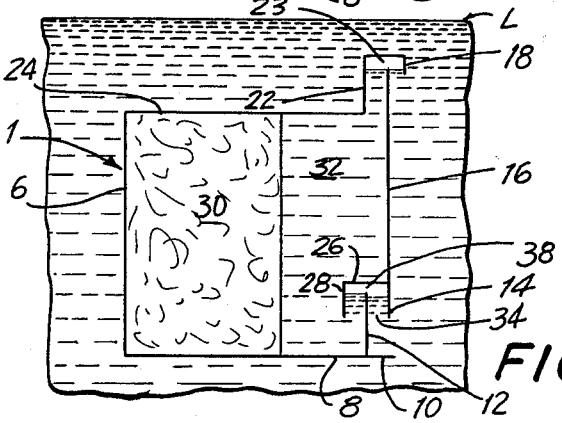
FIG. 4
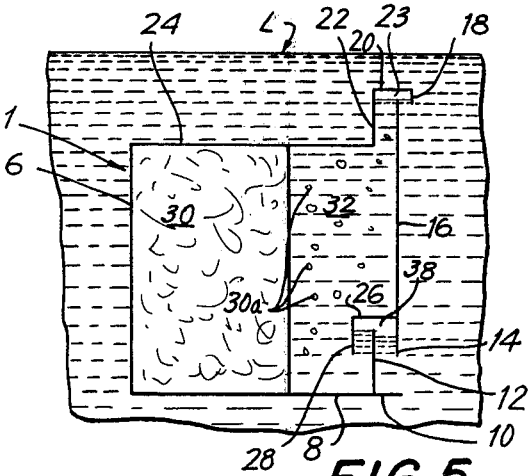
FIG. 5

PASSIVE DISPENSER

BACKGROUND OF THE INVENTION

1. Field of the Invention

The present invention relates to a dosage dispenser for such products as toilet tank additives, e.g. disinfectants, detergents, and the like. More particularly, the present invention relates to a dispenser which comprises no moving parts and employs air locks to isolate the additive-containing solution to be dispensed from the water in the toilet tank during quiescent periods between flushes.

1. Description of the Prior Art

Devices for dispensing a disinfectant solution into a toilet tank for flow into the toilet bowl when the tank is flushed are known. It is generally desired to isolate the disinfectant from the water in the toilet tank during quiescent periods between flushes. To this end, it is known to use valves or other mechanisms which will shut off flow from the dispenser when the toilet tank is filled to a desired level. See, for example, U.S. Pat. Nos. 1,307,535; 2,692,165; 3,073,488; 3,341,074; 3,698,021; 3,778,849; 3,784,058; 3,895,739; and 4,036,407.

Passive dispensers which are devices having no moving parts are also known. In one type of such passive dispensers, the dispensers are alternately flooded and the siphoned when the tank is flushed. See, for example, U.S. Pat. Nos. 650,161; 1,144,525; 1,175,032; 1,213,978; and 3,339,801. In another type, the dispensers are alternately flooded and then drained gravitationally. See, for example U.S. Pat. Nos. 1,987,689; 3,121,236; 3,504,384; 3,545,014; 3,618,143; 3,604,020; 3,772,715; 3,781,926; 3,943,582; and 4,244,062. In addition, U.S. Pat. Nos. 2,688,754; 3,864,763; and 3,965,497 and U.K. Pat. No. 705,904 disclose toilet chemical dispensers in which a small amount of the chemical is released into the tank in the absence of hydrostatic pressure on the spout thereof, e.g., when the toilet has been flushed and the water level in the tank has dropped. As the tank becomes filled with water, the resulting hydrostatic head prevents the solution from being released from the dispenser. In a further type of passive dispenser, the solution to be dispensed is connected to a pressurized water supply such as the trap refill pipe in a toilet tank. See, for example U.S. Pat. Nos. 3,407,412 and 3,444,566 wherein the direction of flow alternates in labyrinth passages. In all of the abovementioned passive dispensers, due to the construction thereof, the disinfectant can flow or diffuse into the toilet tank water.

Passive dispensers using air locks, i.e. pockets of air, to isolate the disinfectant from the tank water during quiescent periods in a toilet tank have been disclosed. For example, U.S. Pat. Nos. 4,171,546 and 4,216,027 disclose passive dispensers which issue a predetermined volume of a toilet tank additive solution into a toilet tank as the water is draining therefrom when the toilet is flushed. According to these patents, an amount of a concentrated additive solution is drawn from a storage place into the tank as the water level therein drops resulting from flushing. The devices are provided with numerous baffles and passageways to form air locks that isolate the concentrated disinfectant solution from the tank water when the toilet tank is in a quiescent state. In these devices, the air locks are located at the top of the device. U.S. Pat. No. 4,186,856 discloses a passive dispenser having air locks formed in the top portion thereof when submerged to isolate the tank water from the disinfectant stored therein. Another passive dispenser is disclosed in U.S. Pat. No. 4,208,747 wherein air locks are also employed to isolate the disinfectant from tank water during quiescent periods. However, the air locks in this dispenser are disposed at different levels whereas those employed in the dispensers of the '546, '856 and '027 patents are at the same level and in the top portion thereof. U.S. Pat. No. 4,251,012 discloses another passive dispenser in which a disinfectant is issued into a toilet tank in measured quantities. Although air locks are also used to isolate the disinfectant from the tank water, this device is so constructed that the disinfectant is stored in a compartment which is not accessible to the tank water, even when the device is completely submerged. The air locks provided in this device are located at the same level near the top portion thereof.

The above mentioned passive dispensers have a common disadvantage, namely, their construction is complex. Tortuous flow paths are required in these devices. As a result, they are difficult to manufacture. Another disadvantage is that for the devices to function properly, these devices must be hung substantially vertically in the tank. Tilting of these devices away from the wall means that the devices will extend into the center portion of the tank and interfere with the operation of the mechanisms, such as outlet valve and float linkage, in the tank. This is particularly significant in the device shown in U.S. Pat. No. 4,208,747 which is equipped with a siphon tube. The presence of the siphon tube means that the lower end of the device is substantially below the water surface. A slight tilt away from the tank wall at the top of the tank will cause the siphon tube, because of its length, to extend into the center of the tank and substantially away from the wall. Thus, there is a need for a passive dispenser which has a simple construction and does not have a length which will cause problems resulting from tilting.

SUMMARY OF THE INVENTION

The present invention provides a passive (no moving parts) dispenser for containing a quantity of a solution isolated from a body of liquid in which the dispenser is immersed and for causing a predetermined volume of the solution to issue from the dispenser in response to the level of the body of liquid being lowered from an upper elevation to a lower one. The dispenser comprises an internal reservoir into which the liquid can flow when the level of the body of liquid is below the upper elevation, an upper venting means in fluid communicaton with the resevoir and including passive means for providing an upper air lock in the path of fluid communication between the reservoir and the upper venting means, and a discharge/refill conduit disposed below the upper venting means and in fluid communication with the reservoir, the inlet/discharge conduit being provided with passive means to form a lower air lock to isolate the solution when the body of liquid is at the upper elevation.

BRIEF DESCRIPTION OF THE DRAWINGS

FIG. 1 is a partially cut away perspective view of the passive dispenser of the present invention.

FIGS. 2–7 are simplified cross-sectional views taken along line 2—2 in FIG. 1 showing separate stages of the flush cycle.

DETAILED DESCRIPTION OF THE INVENTION

Figure 6:
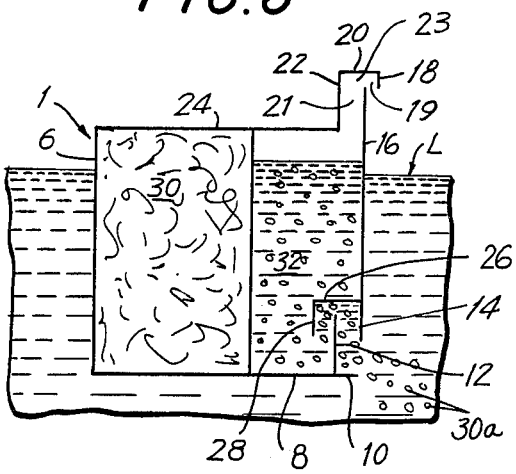

According to the present invention, there is provided a passive dispenser that does not have the disadvantages found in known passive dispensers. More particularly, the present invention provides a passive dispenser of simple yet compact construction. Because a siphon tube is not required, the overall height of the present dispenser can be reduced. Hence, even when tilted away from the toilet tank wall, the dispenser does not extend into and interfere with the various mechanisms and linkages in the toilet tank.

With reference to the drawings, the device of the present invention is generally designated by numeral 1. The dispenser comprises a front wall 2, a back wall 4, side walls 6, 16, top wall 24, bottom wall 8, wall segments 10, 14, 18, 20, 22 and partitions 12, 26, 28. Material to be dispensed, represented by a solid bar or cake 30 of disinfectant, is disposed in dispenser 1, the bar having such dimensions as not to occupy the entire interior space of the dispenser. Accordingly, there exists in dispenser 1 an internal reservoir 32 into which water from the toilet tank (not shown) can flow thereby contacting and dissolving part of solid cake 30 to form a solution. The material to be dispensed may also exist in forms other than a bar, for example, as a gel or semi-solid, as a coating or impregnate with a suitable carrier, or as a pulverulent within a water permeable membrane. The upper portion of side wall 16 extends into the space defined by wall segments 18, 20, 22 to define an upper venting means comprising, as shown in FIG. 1, a pair of vertical passageways 19, 21, said passageways being in fluid communication at their uppermost portions which portions are designated collectively as horizontal channel 23. Vertical wall segment 18 projects downwardly at least to the top-most end of side wall 16 so that when the toilet tank is filled, a pocket of air is trapped within channel 23. To ensure the formation of the air pocket, wall segment 18 preferably should extend below the topmost end of sidewall 16 so that the air pocket is trapped partially within the top portions of passageways 19, 21 below the channel 23.

In the lower portion of device 1, a refill/discharge conduit designated generally as 32R is provided to discharge the solution stored in reservoir 32 and to refill the reservoir subsequently. The conduit 32R comprises a pair of chambers 34, 36 which are in fluid communication only at the uppermost portion thereof. Chamber 34, which serves as an air refill chamber, is bounded by partitions 12, 26, and wall segment 14. Chamber 36, which functions as an air trap chamber, is bounded by partitions 12, 26, and 28 and is in communication with chamber 34 through opening or transfer port 38 disposed above partition 12. As shown, both chambers 34, 36 have a constant cross-sectional area along the longitudinal axes thereof. This can be attained by making members 12, 14, and 28 parallel to one another and partition 26 perpendicular thereto. As explained hereinbelow, the relationship between the cross-sectional areas of chambers 34, 36 and opening 38 is of primary importance in the present invention. Although shown in FIG. 1 as being located adjacent to the bottom wall 8, the discharge/refill conduit 32R can be placed along wall 16 above wall 8, the only requirement being that the conduit is at an elevation below the upper venting means.

FIGS. 2–7, cross-sectional views taken along line 2—2 in FIG. 1, illustrate sequentially a refill and discharge cycle of the dispenser. FIG. 2 shows the dispenser in the toilet tank after a flush and as the tank is beginning to refill, water being already present in chamber 34 above the bottom edge of wall segment 14. Thus, an air pocket is shown to exist in the discharge/refill conduit 32R. A residual amount of solution was retained in the bottom of reservoir 32 after the flush, as hereinafter described, although the reservoir is dry in the initial use of the dispenser. In FIG. 3, the water level L in the tank has risen above partition 26. Because of the difference in hydraulic pressure outside and inside dispenser 1, water flows over wall 12 to initiate filling of internal reservoir 32. As more water enters the toilet tank, water level L in the tank continues to rise, with the level in reservoir 32 also rising. When water level L in the tank rises above wall segment 18, a second air pocket is formed within the upper venting means. FIG. 4 shows the present device 1 completely immersed in the tank water when water level L has reached its highest point. FIG. 5 shows that as a result of contact between the water in reservoir 32 and solid bar 30, a solution **30*a* is formed in reservoir 32. As a result of the presence of air pockets in the upper venting means and in the discharge/refill conduit, the solution in reservoir 32** is isolated from the tank water during quiescent periods between flush and refill cycles.

Figure 7:
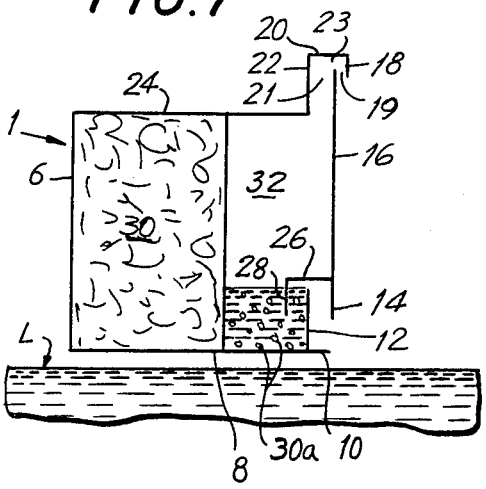

When the toilet bowl is flushed, water level L in the tank drops rapidly, as shown in FIG. 6. The solution **30*a* in reservoir 32 flows into the tank through the discharge/refill conduit due to gravitational pull. Thus, the flow out of reservoir 32 is gravimetric flow and siphoning is not involved. When water level L drops to its lowest point, as shown in FIG. 7, a major portion of the solution 30*a* stored in the reservoir 32 has been dispensed into the tank. The solution remaining in reservoir 32 is retained by vertical wall 12. When the tank water reaches its lowest level, flow out of the tank into the toilet bowl is cut off and the tank is refilled through a ballcock valve (not shown) in the tank. As the tank is refilled, the cycle shown in FIGS. 2–4** is repeated.

The amount of solution **30*a* dispensed into the tank is a function of the volume of reservoir 32, which volume increases over time as the bar 30 dissolves. The concentration of the solution also varies, and is a function of the volume of water in reservoir 32 and the attainment of equilibrium therein. The volume and concentration parameters can be altered in various ways. For example, a portion of the volume of bar 30 could comprise insoluble inerts. Two or more additives, each having the same function but with different solubility rates could be employed to extend the useful life of the dispenser. Similarly, time release could be achieved by encapsulating additives with inert materials of varying solubility. Because a residual volume of solution remains after a flush, the dispensing of at least a dilute solution is always assured, as in the case of a second immediate use of the dispenser. The volume of residual solution is determined by the height of partition 12** inasmuch as the use of a siphon is not employed.

The dimensions for chambers 34, 36 and transfer port 38 are of significant importance in the present invention, as hereinafter described with reference to FIGS. 8–11.

Figure 8:
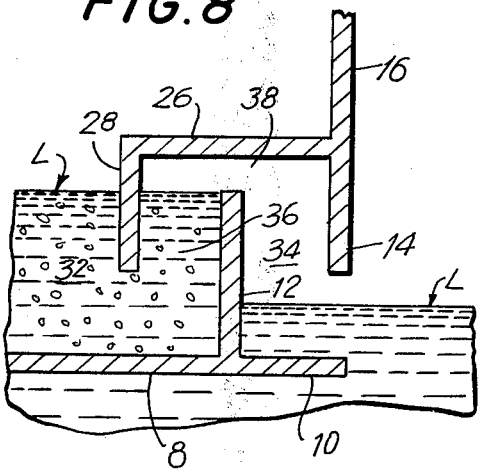
FIGS. 8–11 show the levels of liquid in the discharge/refill conduit as the liquid level in the tank rises.
Figure 10:
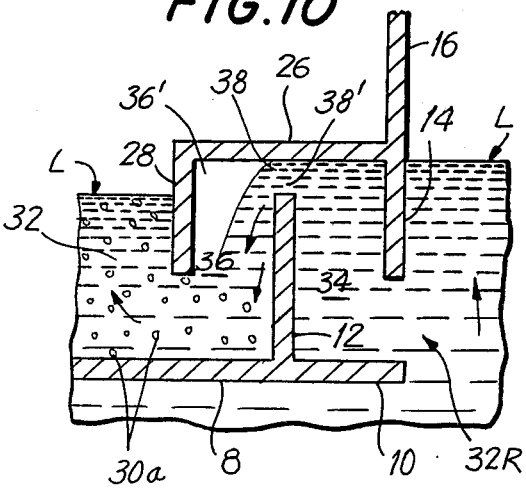
Figure 9:
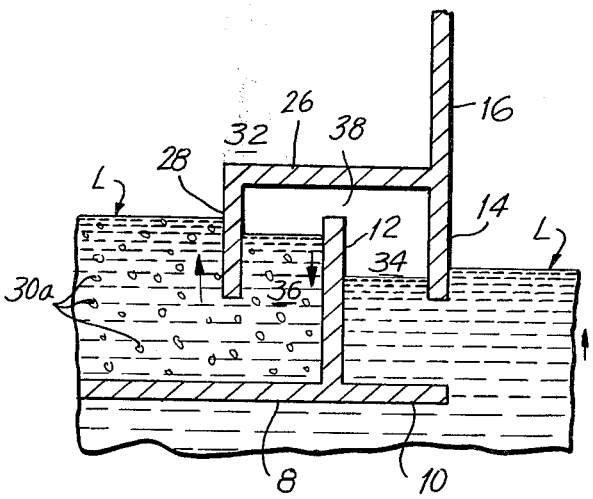
Figure 11:
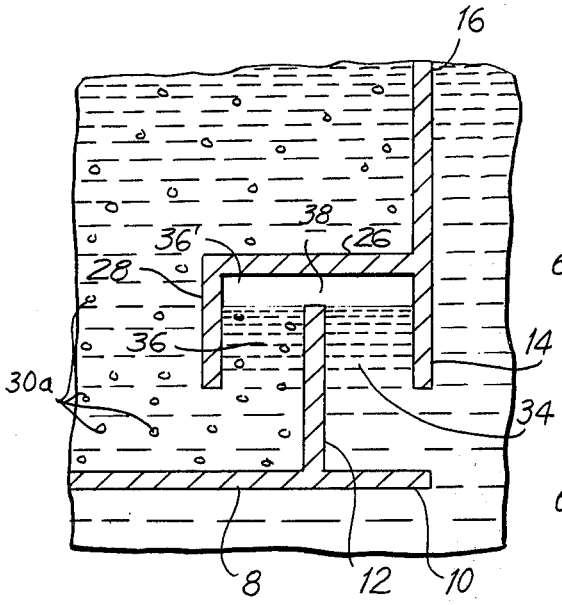

FIG. 8 shows water level L rising as the tank is being filled after flushing. In FIG. 9, the water level L in the tank has risen above wall segment 14 causing air within conduit 32R to displace water in air trap chamber 36. As water level L rises still further (FIG. 10), water flows over vertical wall 12 and into air trap chamber 36 as well as reservoir 32. In a properly designed conduit 32R, a pocket of air 36′ is trapped in chamber 36 nothwithstanding the filling of the reservoir 32 through chambers 34, 36. When the water level rises above the height of the upper air lock, the air pocket 36′ transpositions itself over the entire volume of port 38 as depicted in FIG. 11. If the tank is flushed, the water level L drops rapidly, the air pocket 36′ now in transfer port 38 having an insufficient volume to prevent flow from the reservoir 32 into the tank. As a result, air in transfer port 38 is pushed out through chamber 34 and into the tank followed by the solution 30*a* in reservoir 32.

In order to prevent the air in chamber 36 from being completely displaced into the reservoir 32 by water entering the device when the toilet tank is filling, the cross-sectional area of the wall or plane of water in transfer port 38 above the topmost edge of wall 12 (area designated by numeral 38′ in FIG. 10) should be appreciably smaller than the cross-sectional area of chamber 36. Where the rate of fill of the toliet tank is such that the entire volume of refill chamber 34 would be flooded (up to partition 26), it follows that the cross-sectional area of the wall of water 38′ would coincide or essentially coincide with the cross-sectional area of the transfer port 38. By definition, then, in this instance, the transverse cross-sectional area of transfer port 38 should be appreciably smaller than the cross-sectional area of air trap chamber 36. Conversely, should the rate of fill be low, the water would sluice over wall 12. The cross-sectional area of the water 38′ would be smaller than the cross-sectional area of the transfer port 38, and port 38 then would not acquire critical dimension limitations. Becuse, however, the fill rate cannot be forecast a priori except for specific installations, the preferred embodiment has a smaller transfer port 38 cross section than the cross section of the air trap chamber 36. Thus, the preferred dispenser design would, for fill rates typically encountered in conventionally designed tank systems, flood air refill chamber 34. To provide essentially uniform reservoir 32 filling, and to further ensure retention of the air pocket, it is preferred that chambers 34, 36 have substantially equal cross-sectional areas. Significantly disparate cross sections are not envisioned, although considerable flexibility exists for proper design. Of course, the aforesaid relationships of port or water wall cross-sectional area to air trap chamber cross-sectional area are overriding. Although it is not critical that the cross-sectional areas of air trap chamber 36 and air refill chamber 34 be constant throughout their respective heights, it is critical, and in keeping with the discussion above, that the cross-sectional area of port 38 or plane 38′ be smaller than the largest cross-sectional area of air trap chamber 36.

Figure 12:
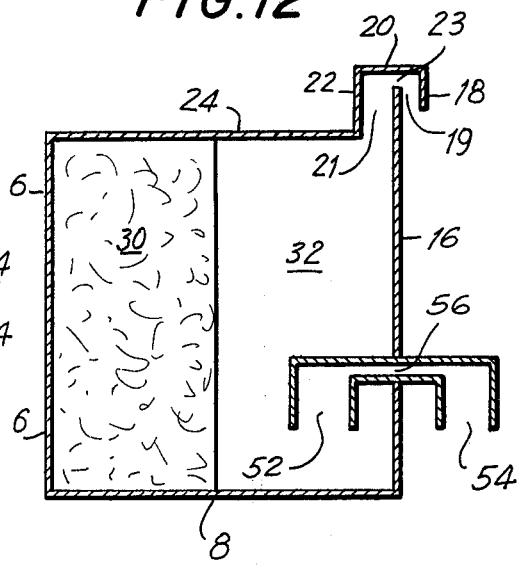
FIGS. 12–14 illustrate cross-sectional views of various configurations of the discharge/refill conduit which can be used in the present invention.

In FIG. 12, the discharge/refill conduit is in the form of an inverted U tube, and disposed in sidewall 16. The conduit comprises two vertical chambers 52, 54 connected at the top portions thereof by a horizontal channel or transfer port 56. Chamber 52 which is adjacent to reservoir 32 constitutes an air trap chamber and chamber 54, which extends into the toilet tank, forms an air refill chamber.

Figure 13:
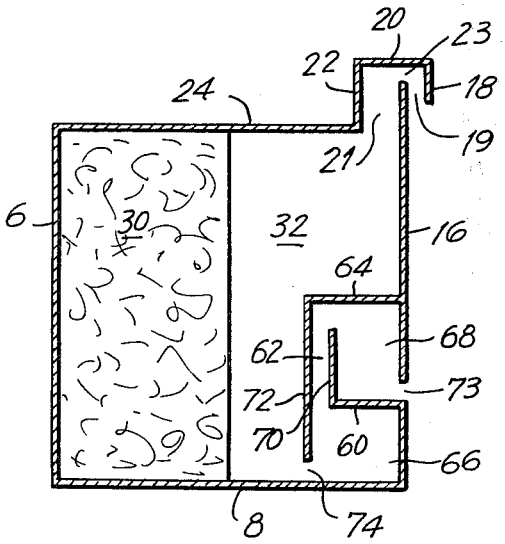

In FIG. 13, the discharge/refill conduit is disposed in the lower corner of the dispenser, and comprises two vertical chambers 66, 68 disposed one above the other and being connected by a vertical passageway or transfer port 62 formed by vertical wall segments 70, 72. Upper chamber 68 constitutes the air refill chamber, while lower chamber 66 is the air trap chamber. Air trap chamber 66 is separated from air refill chamber 68 by horizontal wall 60. Sidewall 72 intersects horizontal wall 64 and extends downwardly toward, but does not come into contact with, bottom wall 8 to define opening 74. Air trap chamber 66 is in fluid communication with reservoir 32, air refill chamber 68 and the toilet tank. Water enters and product solution leaves the dispenser through opening 73.

Figure 14:
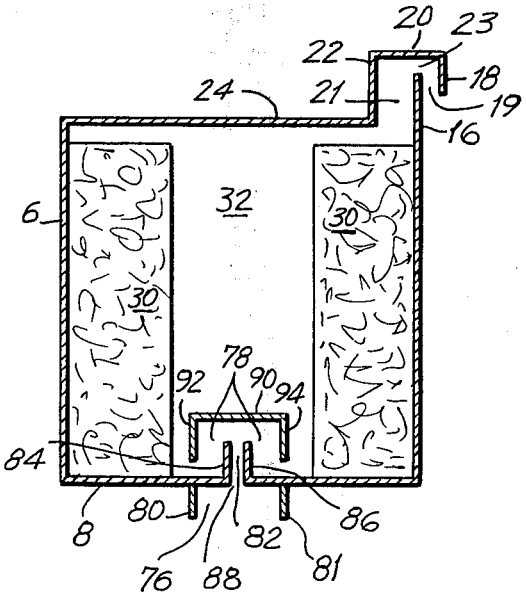

FIG. 14 shows another embodiment of the present invention. In this embodiment, air refill chamber 76, bounded by vertical walls 80, 81, projects outwardly from bottom wall 8. Chamber 76 is in fluid communication with air trap chambers 78 by means of transfer port 82 which comprises a conduit having vertical walls 84, 86 extending upwardly around opening 88 in wall 8. Air trap chamber 78, disposed directly above the air refill chamber 76, is bounded at the top by horizontal wall 90 and at the sides by vertical walls 92, 94.

In each of the embodiments of FIGS. 12 to 14, the relationships described previously concerning the various cross-sectional areas are applicable. Thus, for example, when the chamber 54 is in flooded condition, the cross-sectional area of port 56 should be appreciably smaller than the corresponding area of air trap chamber 52, and chambers 52, 54 preferably have substantially the same cross-sectional areas. In view of the designs of the embodiments illustrated in FIGS. 12 and 14, the likelihood of having port cross sections or plane cross sections larger than air trap chamber cross sections is remote inasmuch as the designs virtually assure flooding of the air refill chambers 54, 76.

Solid bar or cake 30 or the other forms described above, is a water soluble composition useful for providing cleaning, deodorizing or disinfecting benefits to toilet bowls during the flushing cycle and comprises disinfectants, deodorants, a bleaching compound or detergent, or mixtures thereof, which compositions are well known in the art.

It is contemplated that the passive dispenser of the present invention will be used by suspending same from the rim of the toilet tank by hanging means well known in the art. However, other means of placing the dispenser within the tank can be used including, for example, its own weight to maintain the dispenser at the bottom of the tank during use.

The passive dispensers of the present invention can be made of any suitable material using known manufacturing techniques. For example, the dispensers can be made by adhesively securing sections of relatively rigid Plexiglas$_{TM}$ (a product of Rohm & Haas Company). As another example, the dispensers may be vacuum thermoformed in two sections of a material such as polyvinyl chloride, the solid, water soluble bar inserted therebetween and, thereafter, the two sections adhered to each other by, e.g., heat sealing. Other polymeric materials which can be used to form the present dispensers include polyethylene, polypropylene, styrene copolymers, acrylics and the like.

I Claim:

1. A non-siphoning passive dispenser for containing a quantity of a solution isolated from a body of liquid in which the dispenser is immersed and for causing a predetermined volume of said solution to issue from the dispenser solely under conditions of gravity flow in response to the level of said body of liquid being lowered from a first elevation to a second elevation, the dispenser comprising:

a product reservoir containing a solute into which said liquid flows to form said solution when the level of said body of liquid rises from said second elevation to said first elevation, said quantity of solution being stored therein;

venting means in fluid communication with said reservoir, and a discharge/refill conduit disposed below said venting means, said conduit connecting the reservoir with the body of liquid and comprising two chambers in fluid communication with each other, one chamber being adjacent to said reservoir to form an air trap chamber and the other chamber being adjacent to said body of liquid to form an air refill chamber, said air trap chamber and said air refill chamber having wall segments of equal length such that said solution issues from the dispenser due to non-siphonic flow; a transfer port connecting said air trap and air refill chambers, the cross-sectional area of said transfer port normal to fluid flow being smaller than the cross-sectional area of said air trap chamber normal to fluid flow such that air in said conduit is not completely displaced by said liquid when the level of said body of liquid rises from the second elevation to the first elevation, the air being entrapped in said air trap chamber and forming, upon cessation of flow into said reservoir, an air lock in said conduit which substantially isolates said solution from said body of liquid.

2. The dispenser of claim 1 wherein the venting means includes passive means for providing an air lock in the path of fluid communication between the reservoir and said venting means whereby, in combination with the conduit air-lock, isolation of the solution from the body of liquid is achieved.

3. The dispenser of claim 2 wherein said means for providing the air-lock in the venting means comprises a pair of vertically disposed passageways in fluid communication with each other only at their uppermost ends to isolate the solution from the body of liquid surrounding said dispenser.

4. The dispenser of claim 1 wherein said discharge/-refill conduit comprises a pair of vertically disposed passageways in fluid communication with each other only at their uppermost ends to form said transfer port, the passageways constituting the air trap and air refill chambers.

5. The dispenser of claim 1 wherein said discharge/-refill conduit comprises a pair of vertical passageways forming the air refill chamber and the air trap chamber, said air refill chamber being disposed above said air trap chamber, the transfer port being a channel extending from the uppermost portion of the air trap chamber into the air refill chamber, the upper end of the transfer port being at a level above the opening connecting the air refill chamber with said body of liquid.

6. The dispenser of claim 1 further comprising means to suspend the dispenser in the body of liquid.

7. The dispenser of claim 1 wherein the air trap chamber is substantially rectangular in configuration, the air being entrapped in a corner of said air trap chamber when the level of the body of liquid rises from the second elevation to the first elevation.

8. The dispenser of claim 7 wherein the cross-sectional area of the air trap chamber is substantially the same as the cross-sectional area of the air refill chamber.

* * * * *